US007325902B2

(12) United States Patent
Tamahashi et al.

(10) Patent No.: US 7,325,902 B2
(45) Date of Patent: Feb. 5, 2008

(54) INK-JET PRINTER HEAD AND A MANUFACTURING METHOD THEREOF

(75) Inventors: Kunihiro Tamahashi, Mito (JP); Akemi Ouchi, Mito (JP); Tsutomu Maekawa, Hitachinaka (JP); Hidetoshi Fujii, Hitachinaka (JP); Hiroshi Sasaki, Mito (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 356 days.

(21) Appl. No.: 10/968,067

(22) Filed: Oct. 20, 2004

(65) Prior Publication Data

US 2005/0088485 A1 Apr. 28, 2005

(30) Foreign Application Priority Data

Oct. 22, 2003 (JP) ..... 2003-361623

(51) Int. Cl.
*B41J 2/14* (2006.01)
*B05D 7/00* (2006.01)

(52) U.S. Cl. ..... 347/45; 427/419.5

(58) Field of Classification Search ..... 347/45, 347/47; 427/419.5

See application file for complete search history.

(56) References Cited

U.S. PATENT DOCUMENTS 5,073,785 A * 12/1991 Jansen et al. ..... 347/45
5,677,717 A * 10/1997 Ohashi ..... 347/69
6,207,236 B1 * 3/2001 Araki et al. ..... 427/386
6,767,078 B2 * 7/2004 Sato et al. ..... 347/45
7,141,305 B2 * 11/2006 Nakagawa et al. ..... 428/447
2005/0001879 A1 * 1/2005 Miyajima et al. ..... 347/45
2005/0062801 A1 * 3/2005 Kato et al. ..... 347/45
2005/0068367 A1 * 3/2005 Kato et al. ..... 347/45
2007/0085877 A1 * 4/2007 Ohkuma et al. ..... 347/45

FOREIGN PATENT DOCUMENTS

JP 06171094 A * 6/1994
JP 09-277537 10/1997
JP 2000-017490 1/2001

* cited by examiner

*Primary Examiner*—Stephen Meier
*Assistant Examiner*—Rene Garcia, Jr.
(74) *Attorney, Agent, or Firm*—Antonelli, Terry, Stout & Kraus, LLP.

(57) ABSTRACT

An ink-jet printer head is characterized by comprising an organic film coated on the surface of the nozzle plate for discharging ink, in which solid particles having abrasion resistance are dispersed, and a water-repellent film on the surface of the organic film, in which the chains of fluorocarbon polymer is grown.

The head shows improved durability of the chains of the fluorocarbon polymer on the nozzle plate during cleaning of the nozzle surface.

16 Claims, 4 Drawing Sheets

INK-JET PRINTER HEAD AND A MANUFACTURING METHOD THEREOF

FIELD OF THE INVENTION

The present invention relates to an ink-jet printer head and a manufacturing method thereof, more specifically, it relates to a technique of prolonging the lifetime of an ink-repellent surface of a nozzle surface.

BACKGROUND OF THE INVENTION

Ink-jet printer heads of prior art comprise nozzle orifices for discharging ink, ink chambers communicated to the nozzle orifices, and actuators, such as piezoelectric elements or heating elements, for pressurizing the ink chambers. Upon input of a recording signal, the nozzle orifices discharge droplets of ink to record information on a medium. In this technique, the dimensions and dimensional accuracy of the nozzle orifices, from which the ink droplets are discharged, affect the dimensions and dimensional accuracy of the jetted ink droplets.

In addition, the properties of a surface of a member forming the nozzle orifices, particularly of a surface around the nozzle orifices, significantly affect the dimensions and dimensional accuracy of the jetted ink droplets. If ink is attached to the surface around the nozzle orifices to form a non-uniform ink pool, for example, the discharge direction of ink droplets may be deflected, and, at worst, a meniscus to be formed in the nozzle orifices may not be formed due to the ink pool, thus inviting "discharge failures". The surface of nozzles must therefore be maintained chemically uniform. To solve this problem, the surface of nozzles is allowed to be ink-repellent by using a fluorocarbon resin or fluorocarbon polymeric compound. Even according to this technique, however, the nozzle surface requires maintenance or cleaning, since ink derived from, for example, mist of discharged ink pools on the nozzle surface.

Such a fluorine-containing material, however, has low mechanical strength and thereby wears during cleaning. More specifically, a fluorine (F) atom can form only one bond, and a C—F bond cannot form a three-dimensional network structure, since the F atom in the C—F bond cannot form another bond. Thus, the fluorine-containing material inherently has low mechanical strength. In other words, such a fluorocarbon resin as intact cannot play its role in a cleaning system in which the nozzle surface is firmly wiped to thereby remove unnecessary substances such as ink and dust. As a possible solution to this problem, it is disclosed that a polyimide composite electro-deposited film comprising a base polyimide and co-deposited fine particles such as wear-resistant fine particles (for instance, refer to Japanese Patent Laid-Open No. 2000-17490). This technique may be effective for protecting the base polyimide. The film, however, is supposed not to keep its ink-repellent property because the polyimide is damaged during cleaning.

Japanese Patent Laid-Open No. H9(1997)-277537 discloses a technique, in which a film comprising Ni and fine particles of a fluorocarbon resin dispersed therein by an eutectic Ni plating process, and the surface of the Ni plating is removed by the action of laser to expose the fluorocarbon resin to the surface. The resulting film may perform an ink-repellent function derived from the exposed fluorocarbon resin in the early stages but may have a decreased ink-repellent function after repetitive cleaning procedures, since the fluorocarbon resin has low strength and its exposed portions are gradually eliminated during cleaning procedures.

Moreover, it is disclosed that a hydrophobic film consists of a flat hard body and plated the chains of fluorocarbon polymer (for instance, refer to Japanese Patent Laid-Open No. 2000-263793). The hard body ensures the endurance of the chains of fluorocarbon polymer. However, in this case, it is manufactured by using a resin of the fluorine system and it does not have a structure, in which many fluoride molecules are exposed on the outermost surface, so that there was room for the improvement of water-repellent characteristics.

Moreover, the one using perfluoropolyether chains is proposed for the water-repellent film of the nozzle plate (for instance, refer to Japanese Patent Laid-Open No. 2003-1914764). In this case, perfluoropolyether chains are directly formed on the nozzle plate. Because of this, the water-repellent characteristics are excellent, but there was a problem for the endurance.

SUMMARY OF THE INVENTION

Accordingly, an object of the present invention is to provide a technique for protecting a resinous film having C—F bonds from damage during cleaning of nozzles, which resinous film having C—F bonds exhibits ink repellency but has low mechanical strength.

To protect hydrophobic molecules on an ink-repellent layer from a cleaning jig during cleaning of the nozzle surface, the present invention employs an ink-repellent film containing solid particles which are dispersed in a resinous film and protrude from a surface of the resinous film to a specific height so as to avoid the contact between the ink-repellent molecules and the cleaning jig geometrically.

Specifically, the present invention provides an ink-jet printer head including a nozzle plate for jetting ink, and an ink-repellent film, the hydrophobic film being arranged adjacent to a surface of the nozzle plate and including a resinous film, chains of a fluorocarbon polymer being partially embedded in the resinous film and partially exposed at a surface of the resinous film, and solid particles being wear resistant and dispersed in the resinous film, in which at least part of the solid particles protrudes from the surface of the resinous film. The term "resinous film" used herein also includes a resinous layer. Preferably, part of the solid particles protrudes from the chains of the fluorocarbon polymer.

In the ink-jet printer head, it is preferred that, when a protrusion percentage of particles (%) and a volumetric percentage of particles (%) are defined according to following Equations (1) and (2), respectively, the protrusion percentage of particles and the volumetric percentage of particles fall in a range surrounded by four points of a (X=5, Y=20), b (X=5, Y=60), c (X=25, Y=55) and d (X=30, Y=20) in acorrelation diagram with the X-axis indicating the protrusion percentage of particles and the Y-axis indicating the volumetric percentage of particles:

$$P\ (\%)=[(h1-t1)/t1]\times 100 \quad (1)$$

$$C\ (\%)=(v1/v2)\times 100 \quad (2)$$

wherein P (%) is the protrusion percentage of particles; h1 is the height of protruded particles; t1 is the thickness of the resinous film; C (%) is the volumetric percentage of particles; v1 is the volume of the particles; and v2 is the volume of the resinous film.

The present invention proposes a technique for improving durability of an ink-repellent layer (film) arranged on a nozzle plate of an ink-jet head. The contact between a cleaning jig and ink-repellent molecules is geometrically avoided according to the present invention to protect the ink-repellent molecules on a surface having an ink-repellent property from the cleaning jig during cleaning of the nozzle surface. Specifically, one of the most important features of the present invention is that the ink-repellent film is so configured as to be a resin film having solid particles protruded from a surface of the resinous film to a specific height. According to this configuration, the fluorocarbon polymer which performs an ink-repellent function is neither worn nor damaged even during cleaning and can maintain its ink repellency over a long period of time. The object of maintaining the ink repellency over a long period of time is achieved by uniformly dispersing solid particles between the ink-repellent plane and the cleaning plane so as to enable the solid particles to serve as a spacer.

The solid particles to be dispersed in the ink-repellent layer are preferably inorganic particles such as particles of silica, clay or alumina. Each type of these particles can be used alone or in combination. The average particle diameter of the solid particles is preferably somewhat larger than the thickness of the resinous film, is preferably 50 nm to 300 nm, and typically preferably 50 nm to 200 nm. Solid particles having an excessively small particle diameter may not serve as a spacer effectively and may not be dispersed in the resinous film uniformly.

The ink-repellent fluorocarbon polymer for use in the present invention comprises chains of its molecules protruded from the resinous film in the form of whiskers to thereby form a water- and oil-repellent film. Examples of the fluorocarbon polymer are fluorine compounds each having a terminal perfluoroalkyl polyether chain or a terminal perfluoroalkyl chain. Among them, preferred are fluorine compounds each having such a perfluoroalkyl polyether chain or a perfluoroalkyl chain at one end and a terminal group capable of chemically binding to the resinous film and/or the solid particles (filler) at the other end. The chemical structures of the preferred fluorine compounds are as follows:

(1) $Rf—(CH_2)_3—Si(OR')_3$ wherein Rf represents $F(CF(CF_3—CF_2—O—)_m—CF(CF_3)CONH—$ or $F(CF_2—CF_2—CF_2—O—)m'—CF_2—CF_2CONH—$; m and m' each independently represent a natural number; and R' represents $CH_3$ or $C_2H_5$, (2) $Rf'—(CH_2)_p—Si(OR')_3$ wherein Rf' represents $F(CF_2)_q—$; and p and q each independently represent a natural number, (3) $Rf''—Si(OR')_3$ wherein R' has the same meaning as defined above; Rf'' represents $H(CF_2)_{r'}$, wherein r' represents a natural number.

The target water- and oil-repellent film, namely the ink-repellent film, may be prepared by mixing the fluorine compound, the base rein and the solid particles with an appropriate solvent, applying a film of the mixture to a nozzle plate of an ink-jet head, and drying and curing the applied film.

According to the present invention, the fluorocarbon polymer chains which perform an ink-repellent function are protected from wear (abrasion) and damage during cleaning, and the ink repellency of the fluorocarbon polymer chains can be maintained over a long period of time.

DESCRIPTION OF THE PREFERRED EMBODIMENTS

EXAMPLE 1

Figure 1:
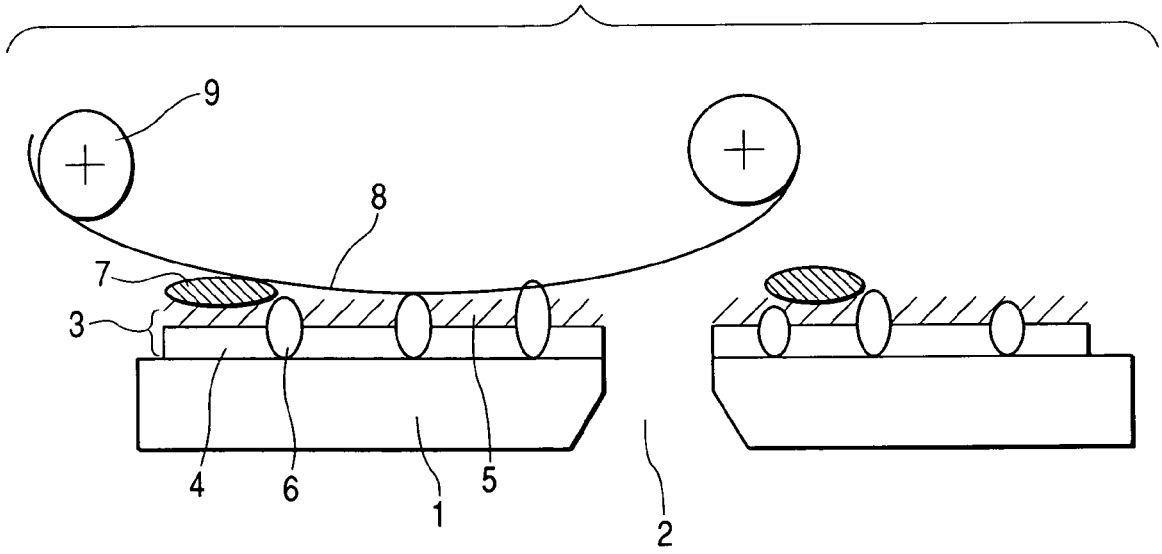
FIG. 1 is an explanatory diagram showing the positional relation between fluorocarbon polymer chains and wear-resistant particles (filler) on a nozzle plate during cleaning in an ink-jet printer head according to the present invention.

An ink-repellent film having an ideal configuration as shown in FIG. 1 will be illustrated in this example. FIG. 1 shows an ink-jet head according to the present invention at one moment during cleaning. The ink-jet head comprises a nozzle plate 1 and an ink-repellent layer 3. The nozzle plate 1 has nozzles 2 for discharging ink. The ink-repellent layer 3 comprises a resinous film 4, solid particles 6 and fluorocarbon polymer chains 5. The resinous film 4 serves also as an undercoat. The solid particles 6 protrude from the ink-repellent layer 3 to a specific height. The fluorocarbon polymer chains 5 are fibrous and protrude from the surface of the ink-repellent layer 3 in the form of whiskers.

FIG. 1 also shows part of a cleaning mechanism including a cleaning wiper 8 and a wind roll 9. Residual ink 7 remained on the ink-repellent layer 3 is in contact with the cleaning wiper 8 and is absorbed by the cleaning wiper 8. The cleaning wiper 8 is wound up by the wind roll 9.

With reference to FIG. 1, the solid particles 6 serve to protect the fibrous fluorocarbon polymer chains 5 performing an ink-repellent function from coming into a hard contact with the cleaning wiper 8. Thus, the fluorocarbon polymer chains are not in contact with or are in a slight contact with the cleaning wiper 8, and wear and damage upon the chains are mitigated as compared with the case using no solid particles.

Figure 2A:
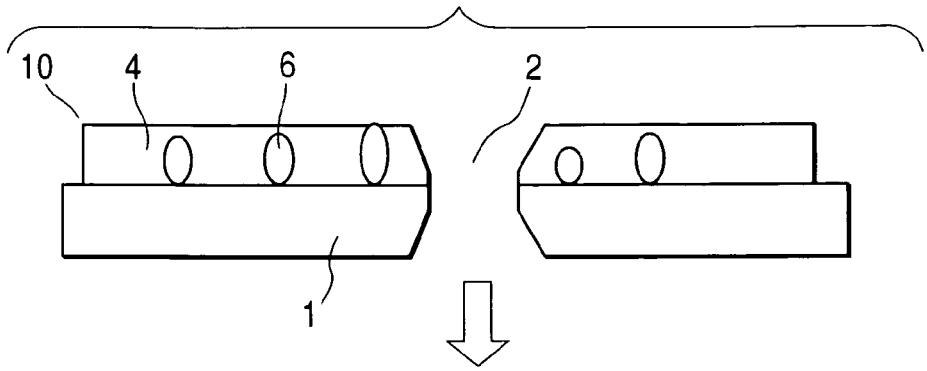
FIGS. 2A, 2B, 2C and 2D show a flow chart illustrating a production process of an ink-repellent film as an embodiment of the present invention.

FIGS. 2A, 2B, 2C and 2D show a production process of the ink-repellent film according to the present invention. FIGS. 3A, 3B, 3C, and 3D show the plan drawings of the nozzle plate. Initially, a mixture containing the solid particles 6 and a material for the resinous film 4 was prepared by using a mixer (not shown). The mixture is applied to the nozzle plate 1 to form a film 10 (FIG. 2A). Particles of silica ($SiO_2$) having an average-particle diameter of 100 nm were used as the solid particles, and an epoxy polymer solution (AS 3000, a product of Hitachi Chemical Co., Ltd.) having corrosion resistance against a wide variety of solvents was used as the material for the resinous film.

Separation of the solid particles (filler) from the resinous film may deteriorate the advantages of the present invention and should be avoided. Accordingly, the surfaces of the solid particles had been treated with gamma-aminopropyltriethoxysilane (γ-APS) as a silane coupling agent. Any treatment, however, will do as long as it can improve adhesion between the solid particles and the resinous film.

Figure 2B:
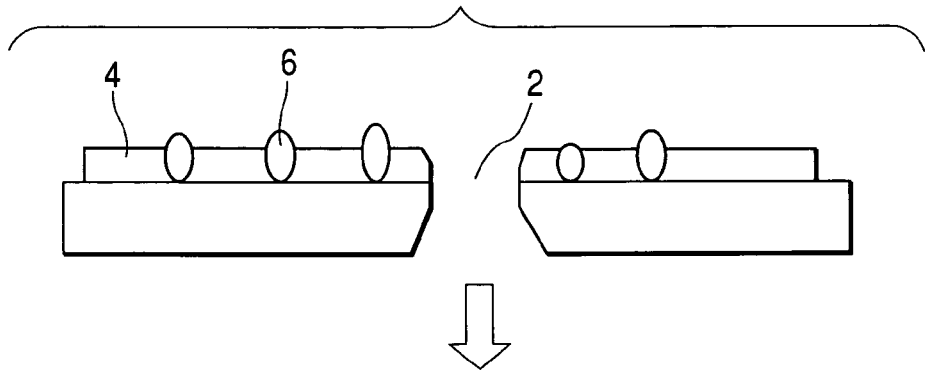
Figure 2C:
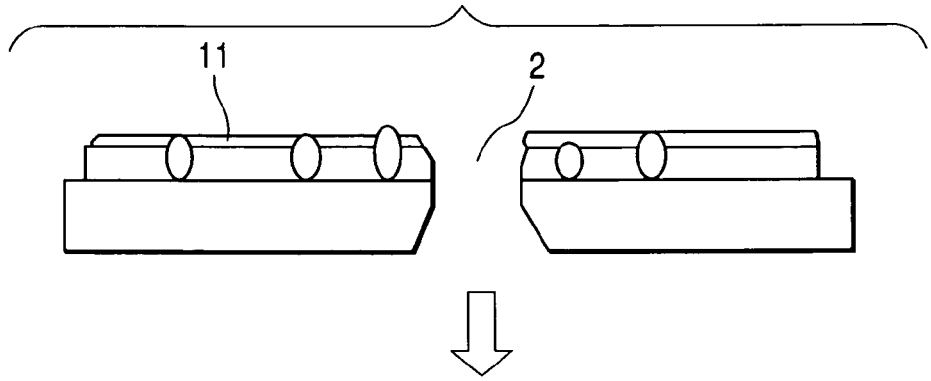
Figure 2D:
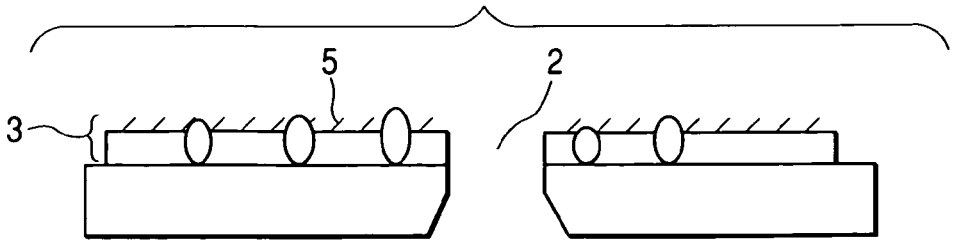

The applied film was dried and cured at 150° C. Thus, volatile components were eliminated, and a complex film of solid components comprising the resinous film 4 and solid particles 6 was formed (FIG. 2B). The solid particles 6 protruded from the surface of the resinous film 4 to a specific height. A solution 11 containing a chain-like fluorocarbon polymer was then applied onto the resinous film 4 (FIG. 2C). The applied film was cured at 130° C. to evaporate the solvent to thereby form a hydrophobic film 3. The hydrophobic film 3 had fibrous fluorocarbon polymer chains 5 each having one end firmly anchored to the resinous film 4 (FIG. 2D).

Figure 3A:
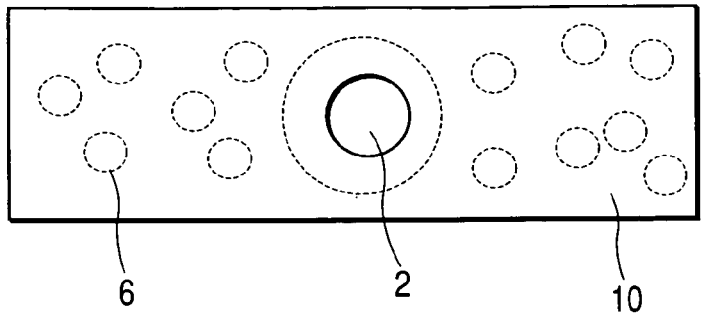
FIGS. 3A, 3B, 3C, and 3D are explanation drawings illustrating a nozzle plate surface in a hydrophobic film manufacturing method.
Figure 3B:
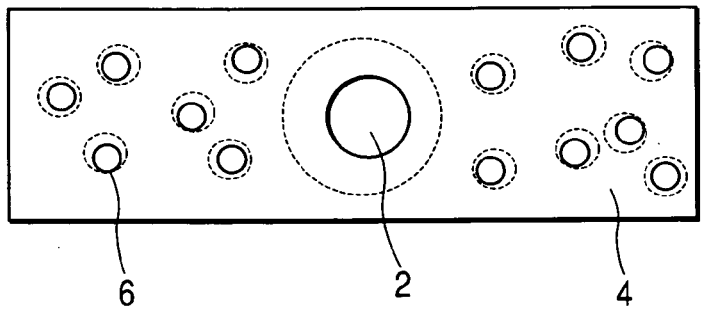
Figure 3C:
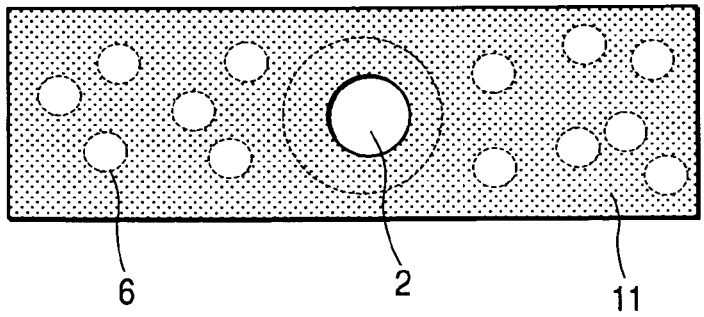
Figure 3D:
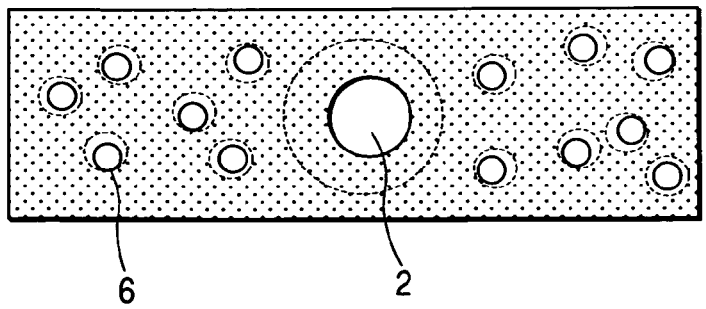

Explaining the surface of the nozzle plate using FIGS. 3A, 3B, 3C, and 3D, FIG. 3A is a picture showing that the solution 10 dispersing the filler 6 is coated on the plate. The filler 6 is not seen from the surface as a film. In FIG. 3B, the solvent of the solution 10 is evaporated by curing (heating) to form the film 4. According to this process, part of the filler 6 first protrudes out of the film. In the next step, FIG. 3C, the solution 11 containing the chains of fluorocarbon polymer is coated. In this figure, although it is pictured that the filler 6 is hidden again, part of filler 6 may protrude. Finally, as shown in the last picture, FIG. 3D, the chains of fluorocarbon polymer is formed by curing as whiskers in a halftone state on the surface. The filler 6 also protrudes out of the film.

The fluorocarbon polymer to form whiskers may be previously added to the mixture for the formation of the resinous film 4. In this case, the fluorocarbon polymer forms whiskers on the resinous film 4 by precuring at about 80° C. before main curing. This is because the fluorocarbon polymer hardly forms a three-dimensional network with the resinous film 4 and thereby is present and dispersed on the surface of the resinous film 4. After precuring, the article may be cured at an elevated temperature, for example, about 150° C. to cure the resinous film 4 and to fasten between the fluorocarbon polymer and the resinous film 4. The resulting fluorocarbon polymer chains are partly embedded (anchored) in the resinous film 4. A variety of processes can be applied to form the hydrophobic film 3, and any process will do as long as the hydrophobic film 3 having the above configuration can be formed.

Next, the relation between the protrusion percentage of particles and wear properties was investigated, which significantly relates to a feature of the present invention. To determine the relation accurately, solid particles having a diameter of 100±10 nm were used.

Figure 4:
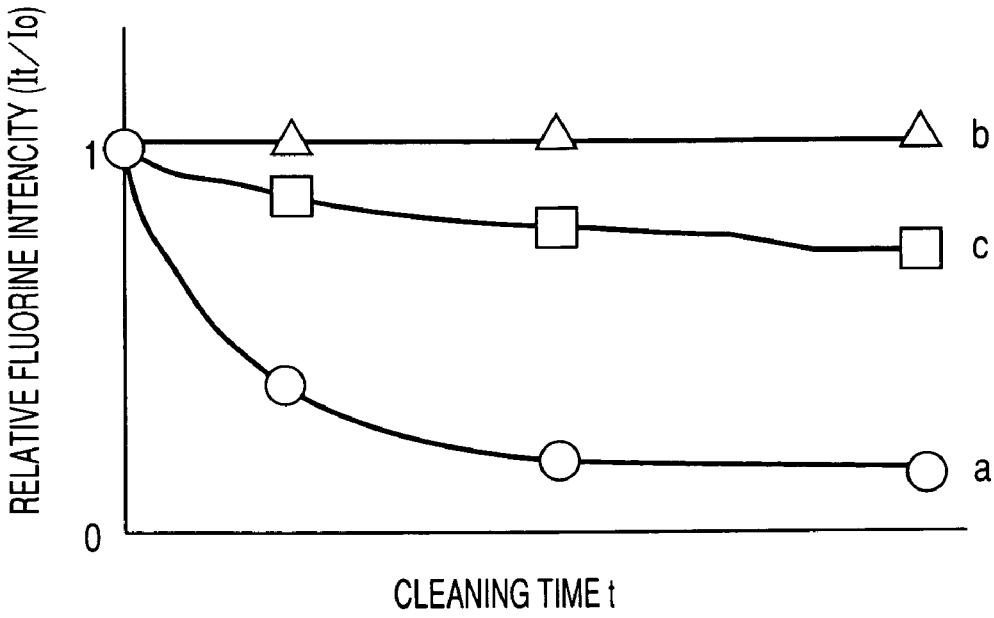
FIG. 4 is a graph showing the durability of ink-repellent films.

The protrusion percentage of particles (%) as used herein is defined according to following Equation:

$$P\ (\%)=[(h1-t1)/t]\times 100$$

wherein P (%) is the protrusion percentage of particles; h1 is the height of a protruded particle and is determined by subtracting the thickness of the resinous film 4 from the diameter of the solid particle 6; and t1 is the thickness of the resinous film 4. FIG. 4 shows an example of the determined relations. In FIG. 4, curves a, b and c show the results of films a, b and c prepared at protrusion percentages of particles of 3%, 20% and 40%, respectively. The thickness of the resinous film 4 as determined herein is 97 μm, 83 μm and 71 μm in the curves a, band c, respectively. The volumetric percentage of particles in this example stands at 20%.

The degree of wear is indicated as a relative fluorine intensity ($I_t/I_0$). More specifically, the amount of fluorine on the surface of the film is detected by electron spectroscopy for chemical analysis (ESCA), and the relative fluorine intensity ($I_t/I_0$) is defined as the ratio of the peak intensity after cleaning ($I_t$) to the initial peak intensity ($I_0$).

As shown in FIG. 3, the film "a" shows a decreased amount of fluorine with the lapse of time and exhibits durability substantially equal to that of a conventional equivalent containing no solid particles. The film "b" shows a substantially maintained relative fluorine intensity (durability), but the film "c" shows somewhat decreased fluorine intensity (amount of fluorine). The film "c" was then observed under a microscope to find that the solid particles (filler) were eliminated in some portions. This is because, if the protrusion percentage of particles is excessively high, the cleaning wiper 8 tends to catch on the protruded solid particles to eliminate the solid particles from the resinous film 4. Thus, the fluorocarbon polymer chains are worn. These results show that there is an appropriate range of the protrusion percentage of particles.

EXAMPLE 2

Figure 5:
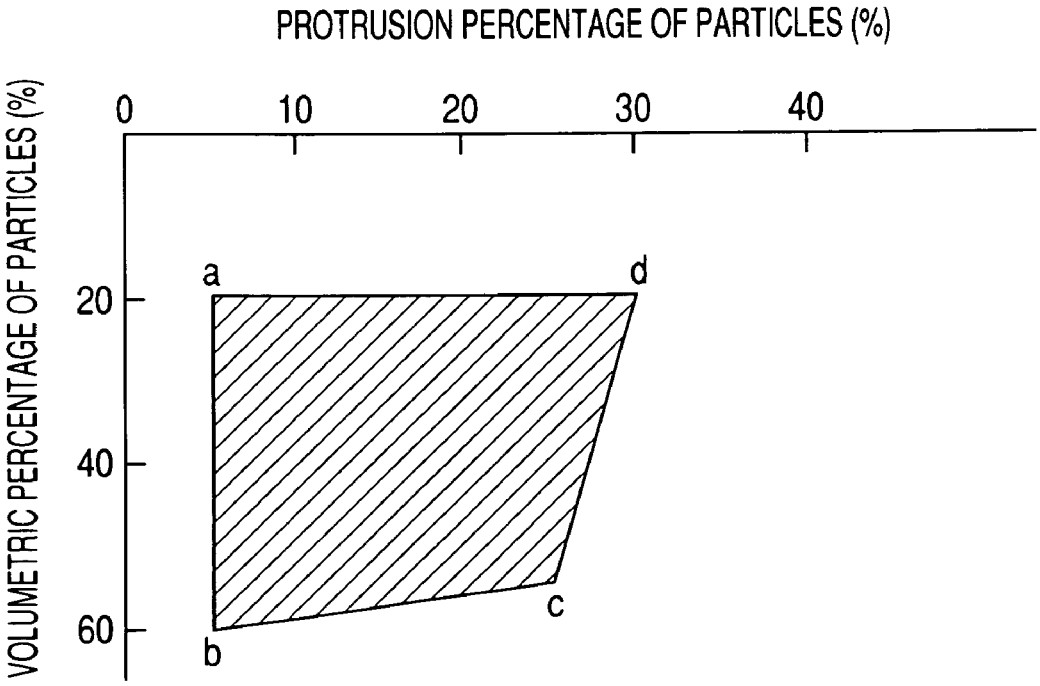
FIG. 5 is a diagram in which the protrusion percentage of particles is plotted against the volumetric percentage of particles of the ink-repellent films described in FIG. 3.

The protrusion percentage of particles and the volumetric percentage of particles were investigated in detail as parameters affecting wear properties. The volumetric percentage of particles (%) can be said as an amount corresponding to gaps between the solid particles 6 when the resinous film 4 is observed from its surface. Specifically, films were prepared at volumetric percentages of particles of 20%, 40% and 60%, respectively, and the relation between the volumetric percentage of particles and the protrusion percentage of particles was determined. The result is shown in FIG. 5. The diagonally shaded area in FIG. 5 is an area of conditions under which the relative fluorine intensity stands at 0.8 to 1 even after repetitive cleaning procedures. The ink can be stably jetted from the ink jet nozzles under these conditions, namely, under such conditions that the relative fluorine intensity stands at 0.8 or above even after repetitive cleaning procedures.

The resulting hydrophobic film can maintain its initial surface configuration even in portions, which require water-repellent and oil-repellent properties and undergo mechanical pressure, and can be applied to walls which require cleaning.

What is claimed is:

1. An ink-jet printer head comprising:

a nozzle plate having a nozzle plate surface for discharging ink an organic film provided on the nozzle plate surface;

solid particles having abrasion resistance dispersed in said organic film; and a water-repellent film provided on a surface of the organic film, the water repellant film comprising chains of fluorocarbon polymer.

2. The ink-jet printer head according to claim 1, wherein at least part of the solid particles protrudes from the chains of fluorocarbon polymer.

3. The ink jet printer according to claim 2, wherein the solid particles comprise an inorganic material.

4. The ink jet printer according to claim 2, wherein the solid particles comprise a material selected from the group consisting of silica, clay and alumina.

5. The ink-jet printer head according to claim 1, wherein, when a protrusion percentage of the solid particles (%) and a volumetric percentage of the solid particles (%) are defined according to following Equations (1) and (2), respectively, the protrusion percentage of the solid particles and the volumetric percentage of the solid particles fall in a range surrounded by four points of a (X=5, Y=20), b (X=5, Y=60), c (X=25, Y=55) and d (X=30, Y=20) in a correlation diagram with an X-axis indicating the protrusion percentage of the solid particles and a Y-axis indicating the volumetric percentage of the solid particles:

$$P\ (\%)\ ((h1-t1)/t1)\times 100 \quad (1)$$

$$C\ (\%)=(v1/v2)\times 100 \quad (2)$$

wherein P (%) is the protrusion percentage of the solid particles; h1 is a height of protruded solid particles; t1 is a thickness of the organic film; C (%) is the volumetric percentage of the solid particles; v1 is thea volume of the solid particles; and v2 is a volume of the organic film.

6. A method for manufacturing an ink-jet printer head in which a water-repellent film is provided on a nozzle plate for discharging ink, wherein the water-repellent film is formed into a structure, in which part of the solid particles protrudes from the resinous film, by the steps of:

(a) coating a solution containing solid particles and a resinous film element on a nozzle plate;

(b) drying the coated solution at 150° C. to form a resinous film;

(c) coating a solution containing the chains of fluorocarbon polymer on the resinous film; and (d) transpiring the solvent by heating at 130° C.

7. A method for manufacturing an ink-jet printer head in which a water-repellent film is provided on a nozzle plate for discharging ink, wherein the water-repellent film is formed into a structure, in which part of the solid particles protrudes from the resinous film, by the steps of:

(a) coating a solution containing solid particles, a resinous film element, and the chains of fluorocarbon polymer on a nozzle plate;

(b) pre-curing at 80° C.;

(c) drying the coated solution at 150° C. to form a resinous film;

(d) coating a solution containing the chains of fluorocarbon polymer on the resinous film; and (e) transpiring the solvent by heating at 130° C.

8. A method of manufacturing an ink-jet printer head according to claim 6 or 7, wherein a surface treatment is applied to the solid particles by a silane coupling agent prior to the process (a).

9. The ink jet printer manufactured by the method according to claim 6 or 7.

10. The ink jet printer according to claim 9, wherein the solid particles comprise an inorganic material.

11. The ink jet printer according to claim 9, wherein the solid particles comprise a material selected from the group consisting of silica, clay and alumina.

12. An ink-jet printer head comprising a nozzle plate and an ink-repellent layer, wherein the ink-repellant layer comprises:

an organic film formed on a surface of the nozzle plate for discharging ink;

chains of fluorocarbon polymer being partially embedded in the organic film and being partially exposed at a surface of the organic film; and particles having abrasion resistance dispersed in the organic film and at least part being protruded from the surface of the organic film, wherein at least part of the particles being protruded from the chains of the fluorocarbon polymer in a direction opposite the nozzle plate surface.

13. The ink-jet printer headed according to claim 12, wherein the fluorocarbon polymer chains are fibrous and protrude from the surface of the organic film in the form of whiskers.

14. The ink-jet printer head according to claim 12, wherein, when a protrusion percentage of particles (%) and a volumetric percentage of particles (%) are defined according to following Equations (1) and (2), respectively, the protrusion percentage of particles and the volumetric percentage of particles fall in a range surrounded by four points of a (X=5, X=20), b (X=5, Y=60), c (X=25, Y=55) and d (X=30, Y=20) in a correlation diagram with an X-axis indicating the protrusion percentage of the particles being protruded from the chains of the fluorocarbon polymer and a Y-axis indicating the volumetric percentage of the particles in the ink-repellant layer:

$$P\ (\%)=((h1-t1)/t1)\times 100 \quad (1)$$

$$C\ (\%)=(v1/v2)\times 100 \quad (2)$$

wherein h1 is a height of the part of the protruded particles being protruded from the chains of the fluorocarbon polymer; t1 is a thickness of the organic film formed on the surface of the nozzle plate; P (%) is the percentage of the protruded height h1 to the thickness t1; C (%) is the volumetric percentage of the particles in the ink-repellant layer; v1 is a volume of the particles; and v2 is a volume of the organic film.

15. The ink jet printer according to claim 12, wherein the particles comprise an inorganic material.

16. The ink jet printer according to claim 12, wherein the particles comprise a material selected from the group consisting of silica, clay and alumina.

* * * * *